US005211365A

United States Patent [19]

Melzian

[11] Patent Number: 5,211,365

[45] Date of Patent: May 18, 1993

[54] DETACHABLE MOUNTING ACCESSORY APPARATUS FOR USE WITH WALL PANEL SYSTEMS

[75] Inventor: John Melzian, Rancho Palos Verdes, Calif.

[73] Assignee: Rubbermaid Office Products, Inglewood, Calif.

[21] Appl. No.: 791,487

[22] Filed: Nov. 12, 1991

[51] Int. Cl.[5] ..... E04G 5/06

[52] U.S. Cl. ..... 248/225.1; 248/221.2; 362/371

[58] Field of Search ..... 248/223.3, 222.1, 222.4, 248/222.3, 223.4, 225.2, 225.1, 221.2; 362/370, 371, 287, 145, 127; 211/187

[56] References Cited

U.S. PATENT DOCUMENTS

| | | | |
|---|---|---|---|
| 1,335,881 | 4/1920 | Dottl | 248/222.1 |
| 1,987,117 | 1/1935 | Levesque | 362/371 X |
| 2,505,588 | 4/1950 | Smith | 248/222.1 |
| 2,587,917 | 3/1952 | Stone | 362/371 X |
| 4,164,009 | 8/1979 | Maquire | 362/371 X |
| 4,684,094 | 8/1987 | Everett | 211/187 X |
| 4,689,726 | 8/1987 | Kretzschmar | 362/127 |
| 4,747,025 | 5/1988 | Barton | 362/370 X |
| 4,931,917 | 6/1990 | Scherf | 362/275 X |

*Primary Examiner*—J. Franklin Foss
*Attorney, Agent, or Firm*—Price, Gess & Ubell

[57] ABSTRACT

A mounting apparatus for mounting to a slotted standard of a wall panel system is provided. The apparatus includes a pair of mounting brackets which engage a pair of slots in the slotted standard. Spacing between the mounting brackets is selectively varied. In use, the pair of brackets is first positioned for convenient insertion into slots of the slotted standard. Then the spacing of the brackets is increased to clamp the brackets securely to the slotted standard. The provision of variable spacing between the pair of brackets also allows the apparatus to be mounted to a variety of slotted standards having different slot spacing. The mounting apparatus thus allows an office lamp or the like to be easily detachably mounted to a wall panel system.

22 Claims, 4 Drawing Sheets

DETACHABLE MOUNTING ACCESSORY APPARATUS FOR USE WITH WALL PANEL SYSTEMS

BACKGROUND OF THE INVENTION

1. Field of the Invention

The invention generally relates to wall unit panel systems and in particular relates to a mounting apparatus for detachably mounting a lamp or the like to a wall panel system.

2. Description of Related Art

Wall panel systems are in wide use. Such systems include a plurality of wall partition panels connected by means of vertical standards. The wall panels are configured to provide individual offices for employees. As the resulting individual offices are frequently rather small, it is desirable to provide an efficient means for mounting an office accessory such as a 15 lamp directly to the wall panel system, thus freeing space on the office desk or floor otherwise occupied by the office accessory.

Copending application Ser. No. 07/708,743 provides an apparatus for mounting a coat hanger, or the like, to a wall panel system. The apparatus is provided with a single hook for engaging with a slot formed in a wall panel standard. The coat hanger is hung from an extending portion of the apparatus.

Although useful, the apparatus of application Ser. No. 07/708,743 does not provide the ideal mounting apparatus for mounting a lamp or the like to a wall unit standard. In particular, the apparatus of application Ser. No. 0/708,743 provides only a single hook for engaging with a single slot of the slotted standard, rather than a pair of hooks for "clamping" onto a pair of slots in the slotted standard. The latter arrangement provides a more secure means for mounting an office accessory to a wall panel system. Such a secure mounting means is desirable for use with articulated lamps which may be frequently repositioned. A single hook mounting apparatus may be accidently disengaged from the slotted standard while the lamp is repositioned.

SUMMARY OF THE INVENTION

It is believed that it will be apparent from the preceding there is a need for a new and improved mounting apparatus for use with wall panel systems. Broadly, the invention is intended to provide a mounting apparatus meeting or fulfilling this need.

It is an object of the invention to provide an apparatus for mounting a lamp, or the like, to a slotted standard of a wall panel system.

It is a further object of the invention to provide a reliable and efficient means for engaging a mounting apparatus to slots in a slotted standard.

It is a further object of the invention to provide a mounting apparatus capable of detachably engaging with two slots within a slotted standard.

It is a further object of the invention to provide a mounting apparatus capable of alternatively mounting to a variety of slotted standards having differently spaced slots.

It is a further object of the invention to provide a mounting apparatus adapted for mounting a lamp to a slotted standard of a wall panel system.

These broad objects of the invention are achieved by providing a detachable mounting apparatus having a housing with upper and lower mounting brackets for engaging with respective upper and lower slots of a slotted standard, and having means for selectively varying spacing between the upper and lower brackets, such that the mounting apparatus can alternatively mount to a variety of slotted standards having differently spaced slots.

In accordance with a preferred embodiment, the housing includes upper and lower mounting brackets for detachably engaging respective slots of the slotted standard. Means are provided for displaceably mounting the upper mounting bracket to the housing.

Preferably, the means for displaceably mounting the upper bracket to the housing comprises a vertical slot formed in a back plate of the housing for receiving the upper mounting bracket, a block disposed for vertical displacement within a chamber formed within the housing, with the block engaging the upper mounting bracket, and a threaded screw disposed through a bore hole formed in an upper plate of the housing with the screw extending through the housing into the chamber and engaging with a tapped bore hole extending into an upper portion of the block. The block is vertically displaceable within the chamber by rotation of the screw such that the upper bracket, secured to the block, is likewise vertically displaced.

In this manner, spacing between the upper and lower mounting brackets is selectively varied such that the tabs of the mounting brackets are positionable within slots of the slotted standard with the tab spacing then increased to clamp the apparatus to the slotted standard. The means for varying the spacing of the mounting brackets also allows the mounting apparatus to be alternatively mounted to any of a variety of slotted standards having differently spaced slots.

Also in accordance with a preferred embodiment, the housing includes a means for mounting a lamp.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DESCRIPTION OF THE PREFERRED EMBODIMENTS

Figure 1:
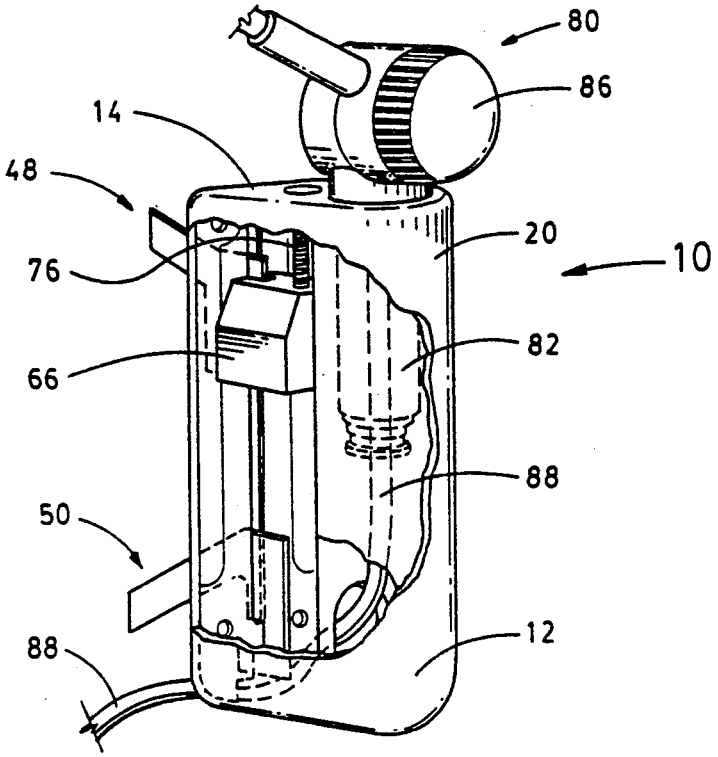
FIG. 1 is a perspective view of a mounting apparatus constructed in accordance with a preferred embodiment of the invention showing, in cutaway, the interior of a housing of the apparatus and showing in fragmentary view, a lamp mounted to the apparatus.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a mounting apparatus for mounting to a slotted standard of a wall unit system.

Referring to the figures, a mounting apparatus 10 in accordance with a preferred embodiment of the invention is shown. Mounting apparatus 10 is shown in its entirety in FIGS. 1, 2, 9 and 10. Various elements of mounting apparatus 10 are shown individually in FIGS. 3–8.

Mounting apparatus 10 includes a housing 12 having a generally flat top wall 14, and generally flat opposing side walls 16 and 18, a generally curved front wall 20 and generally curved bottom wall 22. Housing 12 includes an internal dividing wall 24, shown most clearly in FIG. 10, which subdivides the interior of housing 12 into first and second chambers 26 and 28 respectively. Interior dividing wall 24 connects top and bottom walls 14 and 22, respectively, and opposing side walls 16 and 18, respectively, with first chamber 26 forming a rear chamber and with second chamber 28 forming a front chamber.

Figure 2:
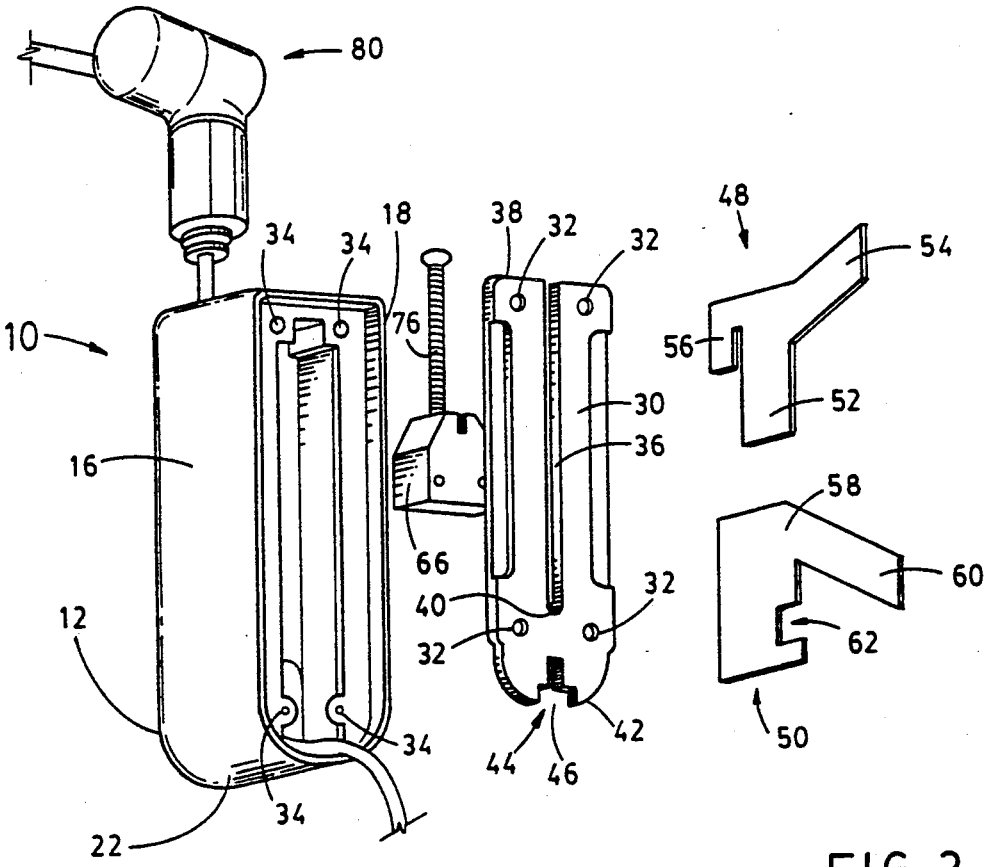
FIG. 2 is an exploded perspective of the mounting apparatus of FIG. 1.

Front chamber 28 is completely enclosed, whereas rear chamber 26, shown most clearly in FIG. 2, is open along a back side of housing 12.

A back mounting plate 30 is provided for mounting over the open rear wall of housing 12 to thus enclosed chamber 26. As shown in FIG. 2, back mounting plate 30 is shaped to match the curved cross-sectional contour of housing 12. Back plate 30 includes four mounting bore holes 32. Back plate 30 is mountable to the rear surface of housing 12 by means of screws, not shown.

Figure 3:
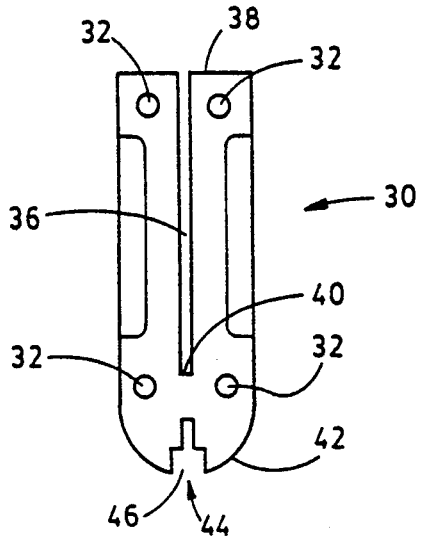
FIG. 3 is an elevational view of a back plate of the mounting apparatus of FIG. 1.

Back plate 30 includes a first, or upper, vertical slot 36 which extends from a top edge 38 of back plate 30 along the length of back plate 30 and terminates at a point 40 intermediate top edge 38 and a bottom edge 42. As can be seen in FIGS. 2 and 3, slot 36 extends along over three-quarters of the length of back plate 30.

Back plate 30 includes a second, or lower, vertical slot 44 extending from curved bottom edge 42 to a position intermediate point 40 and bottom edge 42. As can be seen from FIGS. 2 and 3, second slot 44 is considerably shorter than slot 36 and extends only approximately 1/10 of the total height of back plate 30. Slots 36 and 44 are aligned along a central vertical axis of plate 30. Preferably, vertical slots 36 and 44 have identical widths. However, lower slot 44 also includes a widened end portion 46 which, as will be discussed below, is adapted to receive a power cord.

Mounting apparatus 10 includes first and second mounting brackets 48 and 50 with first bracket 48 being an upper bracket and second bracket 50 being a lower bracket. Each comprise a generally flat plate having a width slightly less than the width of vertical slots 36 and 44.

Figure 5:
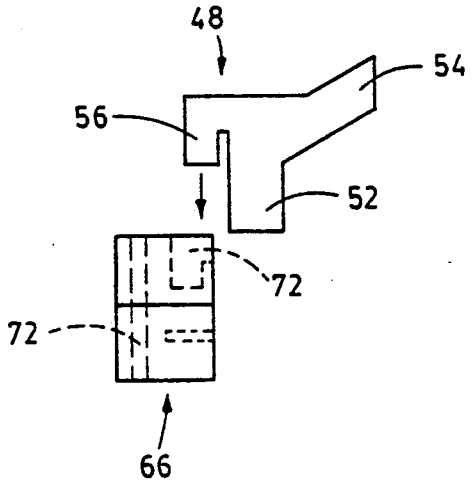
FIG. 5 is a exploded view of the mounting block of FIG. 4 shown receiving an upper mounting bracket of the invention.
Figure 6:
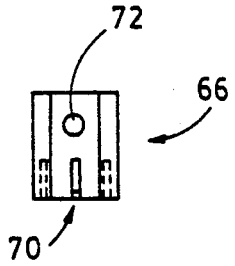
FIG. 6 is a top plan view of the mounting block of the invention.
Figure 7:
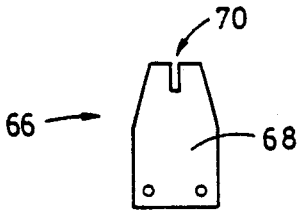
FIG. 7 is a rear elevational view of the mounting block of the invention.

Upper mounting bracket 48 includes a generally rectangular central member 52, a tab member 54 and depending flange member 56. Tab 54 extends upwardly at an angle, as best seen in FIGS. 2 and 5.

Lower mounting bracket 50 includes a generally rectangular central member 58 and a tab member 60 with tab 60 angled downwardly with respect to plate member 58. Lower mounting bracket 50 also includes a notch 62 formed on an edge of plate member 58 below tab 60.

Upper mounting bracket 48 is received within upper vertical slot 36 and is secured therein by a mounting block, discussed below, such that upper mounting bracket 48 is generally perpendicular to rear plate 30.

Figure 9:
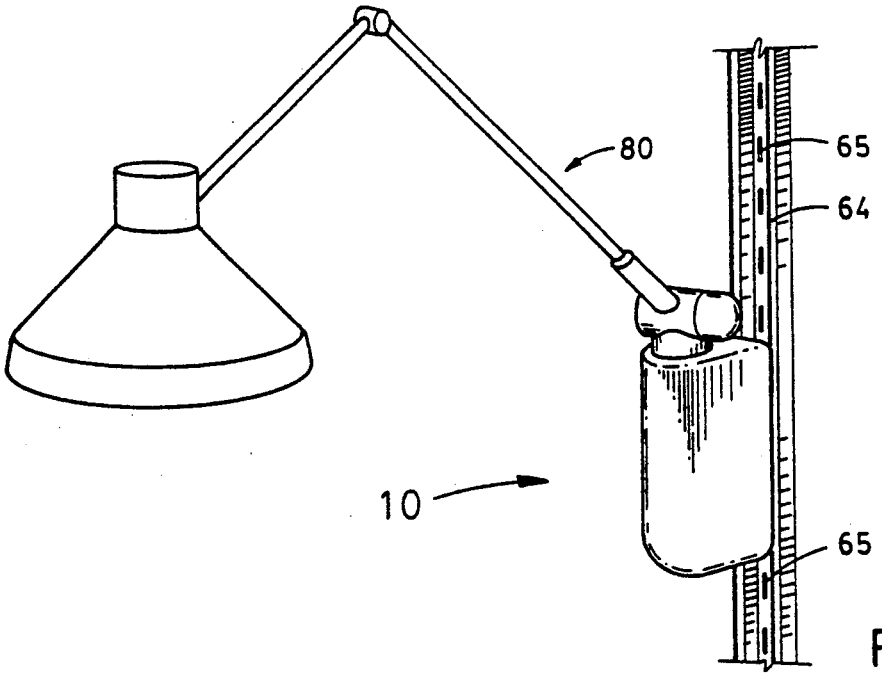
FIG. 9 is a perspective view of the mounting apparatus of FIG. 1 shown in combination with a lamp and shown mounted to a slotted standard having recessed slots.

In this manner, tab 54 extends outwardly and upwardly from rear plate 30 for engaging a first slot, of a slotted standard 64, shown in FIGS. 9 and 10 and described in more detail below.

Lower mounting bracket 50 is received by upper and lower slots 36 and 44 respectively with notch 62 engaging with a lower portion of rear plate 30 between the lower end 40 of upper slot 36 and the upper end of lower slot 44. In this manner, lower mounting bracket 50 is oriented generally perpendicularly to rear plate 30 with tab 60 extending outwardly and downwardly for engaging with a second slot of slotted standard 64 shown in FIGS. 9 and 10. The orientation of upper and lower brackets 48 and 50 with respect to housing 12 is shown most clearly in FIG. 10. Lower bracket 50 is shown as having a slightly larger mounting notch 62 in FIG. 10 than in FIG. 2. It should be readily apparent, that lower mounting bracket 50 can be configured with a notch 62 of arbitrary size subject only to the constraint that the vertical height of notch 62 must be at least larger than the distance between lower end 40 of upper vertical slot 36 and the upper end of lower vertical slot 44. Preferably, the vertical height of notch 62 matches this distance exactly, such that lower mounting bracket 50 snugly engages rear plate 30.

A mounting block 66 is provided within rear chamber 26 for displaceably securing upper mounting bracket 48 within upper vertical slot 30.

Mounting block 66 includes a rear surface 68 adapted for positioning against rear plate 30. A mounting slot 70 is formed within mounting block 60 for receiving depending flange 56 of upper mounting bracket 48.

The shape of mounting block 56 is shown most clearly with reference to FIGS. 4–8 showing, respectively, various top, side and perspective views. The internal shape of slot 70 is shown in phantom lines, within FIG. 5. As can be seen from FIG. 5, the cross sectional shape of slot 70 corresponds with the cross sectional shape of depending flange 56 of upper bracket 48.

Figure 10:
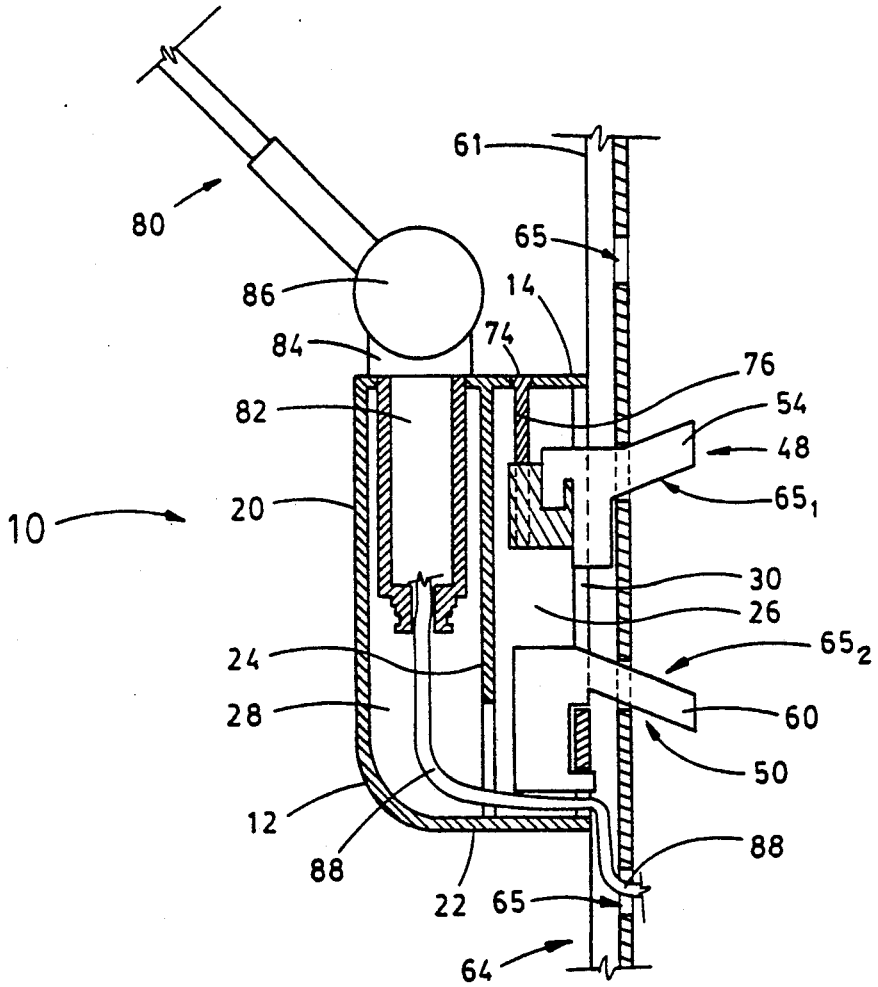
FIG. 10 is a side elevational view, partially in cross-section, of the mounting apparatus of the invention shown mounted to a slotted standard having recessed slots.

In use, as shown most clearly in FIG. 10, mounting block 66 is positioned within rear chamber 26 adjacent to rear plate 30. Depending flange 56 of upper mounting bracket 48 is inserted into mounting slot 70 such that mounting bracket 48 is secured within vertical slot 36 with angled tab 54 extending generally outward. Depending flange 56 and mounting slot 70 are dimensioned such that plate member 52 of mounting bracket 48 rests securely against rear wall 68 of mounting block 66.

Figure 4:
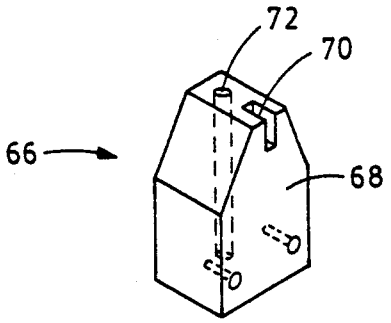
FIG. 4 is a perspective view of a mounting block of the apparatus of FIG. 1.
Figure 8:
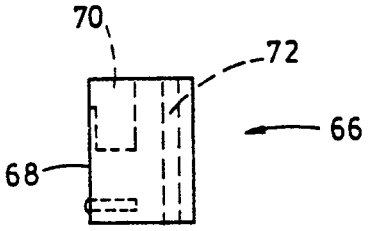
FIG. 8 is a side elevational view of the mounting block of the invention showing, in phantom lines, internal structure of the mounting block.

A tapped bore 72, shown in phantom lines in FIGS. 4, 5 and 8, extends vertically through the entire height of mounting block 66. Top wall 14 of housing 12 is provided with a bore hole 74 for passing a screw 76 through upper plate 14 into bore hole 72 of mounting block 66. Interior bore hole 72 is tapped with threads for engaging with threads formed on mounting screw 76. In this manner, mounting block 66 is secured within rear chamber 26 by screw 76. The provision of tapped bore holes 72 allows mounting block 66 to be displaced vertically within rear chamber 26 by manual rotation of mounting screw 76. Although not shown, mounting screw 76 can be provided with an upper slot for receiving the head of a screw driver such that mounting screw 76 can be easily manually rotated. Also, although not shown, threaded screw 76 can be provided with a wing nut head such that mounting screw 76 can be easily rotated without the need for a tool such as a screw driver.

Thus means are provided for securing mounting block 66 within rear chamber 26 at a chosen height therein and means are provided for selectively raising or lowering mounting block 66 within rear chamber 26. In this manner, upper mounting bracket 48, is likewise raised or lowered. Thereby, vertical spacing between tab 54 of upper mounting bracket 40 and tab 60 of lower mounting bracket 50 is easily selectively varied.

In use, upper mounting bracket 48 is raised or lowered by an appropriate mount to match the spacing between slots, in a slotted standard 64. Slotted standard 64 is shown in FIGS. 9 and 10. In the embodiment of FIGS. 9 and 10, standard 64 has recessed slots generally denoted 65. Standard 64 includes an outer surface 61 with slots 65 recessed within a vertical grove. As can be seen in partial cross-section in FIG. 10, upper tab 54 engages with a first, upper slot $65_1$, and lower tab 60 engages with a second, lower slot $65_2$. Back plate 30 rests against outer surface 61 with the grove providing space for receiving the portion of plate member 52 extending outward beyond back plate 30. The grove also provides space for receiving a power cord 88, described below.

In an alternative embodiment of standard 64, not shown, slots 65 are formed directly on the outside surface of standard 64. Although not shown, mounting brackets 48 and 50 are easily configured for use with such a standard. To this end, upper bracket 48 may be further recessed within chamber 26 or, alternatively, plate member 52 of upper bracket 48 may be constructed of a smaller size so to not extend outward beyond back plate 30.

Initially, spacing is chosen such that extending tabs 54 and 60 are easily received within slots $65_1$ and $65_2$. Once inserted, upper mounting bracket 48 is raised to increase the spacing between tabs 54 and 60 until tabs 54 and 60 securely clamp to upper and lower edges, respectively, of slots $65_1$ and $65_2$.

Thus, mounting apparatus 10 is conveniently positioned against slotted standard 64 and then easily secured to slotted standard 64 by merely increasing the spacing between tabs 54 and 60. Although the means for raising and lowering mounting block 66 has been shown and described with respect to a tapped bore hole 72 used in combination with a threaded screw 76, any other suitable means for raising or lowering upper mounting bracket 48 can be advantageously employed. Also, upper bracket 48 may be fixedly mounted with lower bracket 50 displaceably mounted. Alternatively, both brackets may be displaceable.

The provision of variable spacing between upper mounting bracket 48 and lower mounting bracket 50 is further advantageous as it conveniently enables mounting apparatus 10 to be alternatively mounted to a variety of standards having differently spaced slots. Thus, for example, a slotted standard provided by one manufacturer may include slots five inches apart, whereas a standard provided by another manufacturer may provide slots four inches apart. Merely by raising or lowering upper mounting bracket 48, mounting apparatus 10 is readily adapted for mounting to either of the slotted standards. The range of variable spacing for upper and lower mounting brackets 48 and 50 is limited only by the length of vertical slot 36. By providing a vertical slot 36 with greater length, the mounting apparatus is hereby configured to provide for greater bracket spacing.

Of course, upper and lower mounting brackets 48 and 50 need not engage adjacent slots formed in slotted standard 64. Rather, upper and lower mounting brackets 48 and 50 are insertable into non-adjacent slots if such is more convenient or if adjacent slots are too closely spaced to receive mounting brackets 48 and 50.

Referring to FIGS. 1, 2, 9 and 10, mounting apparatus 10 is shown including a lamp 80. Lamp 80 includes a generally cylindrical stem 82, a base 84 and pivoting member 86. Upper wall 14 of housing 12 includes an opening for receiving stem 82 within front chamber 28. Base 84 of lamp 80 rests upon upper wall 14 around the perimeter of the opening. Base 84 is rotatable with respect to housing 12 such that lamp 80 is conveniently positionable. Lamp 80 includes a power cord 88 extending from a bottom end of stem 82. Internal wall 24 includes an opening for receiving power cord 88 and, as mentioned above, lower slot 44 of rear plate 30 includes a widened portioned 46 also for receiving power cord 88. In this manner, power cord 88 is passed from forward chamber 28 through rear chamber 26 out of housing 12 for ultimate connection to a power source. Depending upon the size of the slots within slotted standard 64, power cord 88 can be advantageously passed into or through slotted standard 64.

Although shown mounting a lamp to a slotted standard, mounting apparatus 10 is advantageously used to mount a variety of accessories to a slotted standard.

Thus described, mounting apparatus 10 provides a reliable and inexpensive means for mounting an office accessory such as a lamp to a slotted standard of a wall panel system. The provision of upper and lower mounting brackets and allow the mounting apparatus to be more securely mounted to a slotted standard than a mounting apparatus having only a single bracket for engaging with a single slot. The above-described means for selectively varying the spacing of the upper and lower mounting brackets allows the mounting brackets to b conveniently inserted into a slotted standard then separated to clamp the brackets to the slotted standard. The provision for varying the spacing between the brackets also allows the mounting apparatus to be easily removed from the slotted standard by merely decreasing the spacing between the brackets until the mounting brackets are easily withdrawn from the respective slots of the standard. Additionally, the provision of means for varying the spacing between the upper and lower mounting brackets allows the mounting apparatus to be mounted to any of a variety of slotted standards having different slot spacings.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A mounting apparatus for detachably mounting to a slotted standard of a wall panel system, said mounting apparatus comprising:

a housing having a back plate;

upper and lower mounting brackets, each having a tab for detachably engaging a respective slot of the slotted standard;

means for mounting said lower mounting bracket to said back plate with said tab extending generally outward from said back plate;

a vertical slot formed in said back plate for receiving said tab of said upper mounting bracket;

a block disposed for vertical displacement within a chamber formed within said housing, said block engaging said upper mounting bracket; and a threaded screw disposed through a bore hole formed in a upper plate of said housing, said screw extending through said housing into said chamber for engaging with a tapped bore hole extending into an upper portion of said block;

said block being vertically displaceable within said chamber by rotation of said screw such that said upper bracket, secured to said block, is displaced within said slot relative to said housing such that spacing between said upper and lower mounting brackets is selectable.

2. The mounting apparatus of claim 1, wherein said back plate is detachably mounted by a plate mounting means to said housing over said chamber.

3. The mounting apparatus of claim 2, wherein said plate mounting means comprises a plurality of screws passing through bore holes in said back plate and engaging with tapped bore holes in said housing.

4. The mounting apparatus of claim 1, wherein said lower mounting bracket comprises a vertical plate, with said tab of said lower mounting bracket extending outward from an upper edge of said plate, and said means for mounting said lower mounting bracket to said back plate comprises:

a vertical slot extending upward from a lower edge of said back plate to a position intermediate said lower edge and said upper slot, and a notch formed in said vertical plate for engaging with said lower and upper slots of said back plate such that said tab of said lower mounting bracket extends outward through said upper slot.

5. The mounting apparatus of claim 1, wherein said tapped bore hole in said block extends completely through said block.

6. The mounting apparatus of claim 1, wherein said housing further includes means for holding a lamp.

7. The mounting apparatus of claim 6, wherein said means for holding a lamp comprises a bore extending through an upper wall of said housing for receiving a stem of said lamp with said stem of said lamp being supported by, and depending through, said upper plate of said housing, with said stem depending into said chamber.

8. The mounting member of claim 7, wherein said housing includes an opening for passing a power cord of said lamp from said stem out of said housing.

9. The mounting member of claim 8, wherein said opening for said power cord is disposed through a portion of said back plate.

10. The mounting member of claim 7, wherein said bore extending through said upper plate of said housing is circular and said stem is in the form of a cylinder such that said lamp is rotatable with respect to said housing.

11. The mounting apparatus of claim 7, wherein said housing forms first and second chambers with said stem of said lamp being disposed in said second chamber and said block being disposed in said first chamber.

12. The mounting means of claim 11, wherein said housing includes an opening for passing a power cord of said lamp from said stem through a wall separating said first and second chambers into said second chamber, and said housing includes an opening for passing said power cord from said second chamber out of said housing.

13. A mounting apparatus for detachably mounting to a slotted standard of a partition wall unit, said mounting apparatus comprising:

a housing;

first and second mounting brackets mounted to said housing, said brackets detachably engaging respective slots of the slotted standard, with said second mounting bracket including a plate with a tab extending outward from an edge of said plate;

a first vertical slot formed in said housing for receiving said first mounting bracket;

a second vertical slot formed in said housing;

a notch formed in said plate of said second mounting bracket for engaging with said first and second slots of said housing, with an upper portion of said second bracket extending outwardly through said first slot and a lower portion of said second mounting bracket extending outwardly through said second slot;

a block disposed for vertical displacement within a chamber formed within said housing, said block engaging said first mounting bracket; and means for selectively displacing said block within said chamber to thereby selectively displace said first mounting bracket such that spacing between said first and second mounting brackets is selectively variable.

14. The mounting apparatus of claim 13, wherein said second mounting bracket comprises a plate with a tab extending outward from an edge of said plate, and said means for mounting said second mounting bracket to said housing comprises:

a vertical slot formed in a portion of a rear side of said housing and a notch formed in said plate for engaging with said first and second slots of said housing such that said lower bracket extends outward through said first slot.

15. The mounting apparatus of claim 13, wherein said means for selectively displacing said block within said chamber comprises a threaded screw disposed through a bore hole formed in a wall of said housing, said screw extending through said housing into said chamber and engaging with a tapped bore hole extending into a portion of said block.

16. The mounting apparatus of claim 15, wherein said tapped bore hole in said block extends completely through said block.

17. The mounting apparatus of claim 13, wherein said housing further includes means for holding a lamp.

18. The mounting apparatus of claim 17, wherein said means for holding a lamp comprises a bore extending through a wall of said housing for receiving a stem of said lamp with said stem of said lamp being supported by, and extending through, said wall of said housing, said stem extending into said chamber.

19. The mounting apparatus of claim 18, wherein said housing forms front and rear chambers, said stem of said lamp being disposed in said front chamber, with said block being disposed in said rear chamber.

20. A mounting apparatus for detachably mounting to a slotted standard of a wall panel system, said mounting apparatus comprising:

a substantially enclosed housing;

upper and lower mounting brackets, extending from a rear surface of said housing, for engaging with respective upper and lower slots of the slotted standard;

a lamp;

a base of said lamp mounted to said housing; and means for selectively varying spacing between said upper and lower mounting brackets, such that the mounting apparatus is mountable to a variety of slotted standards having different slot spacing.

21. A mounting apparatus for detachably mounting to a slotted standard of a partition wall unti, said mounting apparatus comprising:

a substantially enclosed housing;

means for mounting an office appliance to said housing;

first and second mounting brackets mounted to said housing for detachably engaging respective slots of the slotted standard;

a first vertical slot formed in said housing for receiving said first mounting bracket;

a block disposed for vertical displacement within a chamber formed within said housing, said block engaging said first mounting bracket; and means for selectively displacing said block within said chamber to thereby selectively displace said first mounting bracket such that spacing between said first and second mounting brackets is selectively variable.

22. The mounting apparatus of claim 21, wherein said office appliance is a lamp.

* * * * *